US005330094A

United States Patent [19]

Mertz

[11] Patent Number: 5,330,094

[45] Date of Patent: Jul. 19, 1994

[54] STACKABLE DISPLAY TRAY

[75] Inventor: Noel J. Mertz, Geneva, Ill.

[73] Assignee: Jefferson Smurfit Corporation, Clayton, Mo.

[21] Appl. No.: 167,162

[22] Filed: Dec. 16, 1993

[51] Int. Cl.[5] ..... B65D 5/50

[52] U.S. Cl. ..... 229/167; 229/178; 229/191; 229/195; 229/918; 229/919

[58] Field of Search ..... 229/164, 167, 168, 169, 229/178, 191, 195, 915, 918, 919

[56] References Cited

U.S. PATENT DOCUMENTS

| | | | |
|---|---|---|---|
| 3,310,219 | 3/1967 | Obugopdski | 229/191 |
| 4,091,985 | 5/1978 | Holzinger | 229/195 |
| 4,169,553 | 10/1979 | Cain | 229/919 |
| 4,770,339 | 9/1988 | Weimer | 229/178 |
| 5,114,034 | 5/1992 | Miller et al. | 229/195 |
| 5,125,568 | 6/1992 | Bauer | 229/191 |

FOREIGN PATENT DOCUMENTS

| | | | |
|---|---|---|---|
| 101467 | 7/1965 | Denmark | 229/167 |
| 556550 | 2/1957 | Italy | 229/915 |
| 586813 | 12/1958 | Italy | 229/178 |
| 691873 | 7/1965 | Italy | 229/178 |
| 964940 | 7/1964 | United Kingdom | 229/918 |
| 2194776 | 3/1988 | United Kingdom | 229/918 |

*Primary Examiner*—Gary E. Elkins
*Attorney, Agent, or Firm*—Richard W. Carpenter

[57] ABSTRACT

A collapsible, stackable, display tray with single-ply side walls and multi-ply end walls that each include a pair of outer flaps, an outer panel, a pair of inner flaps, an inner panel, and a pair of hollow corner posts connected to the inner panel and positioned between the inner flaps panel and the inner panel.

20 Claims, 5 Drawing Sheets

STACKABLE DISPLAY TRAY

BACKGROUND OF THE INVENTION

1. Field of the Invention

This invention relates to display trays of the type used hold merchandise for display in a store, and more particularly to collapsible, paperboard trays adapted to be stacked with similar trays, one atop the other.

2. Description of the Background Art

A background art search directed to the subject matter of this invention conducted in the United States Patent and Trademark Office disclosed the following U.S. Pat. Nos.: 205,531; 708,445; 1,124,088; 2,105,953; 2,228,377; 2,331,551; 2,395,542; 2,462,693; 2,464,904; 2,505,034; 2,608,340; 2,663,487; 2,783,915; 2,973,802; 2,878,983; 3,010,635; 3,059,829; 3,373,923; 3,520,409; 3,568,877; 3,669,341; 3,722,735; 3,895,715; 4,111,306; 4,165,003; 4,295,599; 4,317,536; 4,323,188;

None of the patents uncovered in the search discloses a one-piece, collapsible, stackable, display tray with single-ply side walls and end walls that each include a pair of outer flaps, an outer panel, a pair of inner flaps, an inner panel, and a pair hollow corner posts connected to the inner panel and interposed between the inner panel and the inner flaps.

SUMMARY OF THE INVENTION

It is a primary object of the invention to provide an improved display tray adapted to be easily and safely stacked with similar trays one atop the other.

Another object of the invention is the provision of a tray of the type described that is collapsible and can be formed from a unitary sheet of foldable sheet material, such as paperboard.

A more specific object of the invention is to provide a display tray with single-ply side walls and end walls that each include a pair of outer flaps, an outer panel, a pair of inner flaps, an inner panel, and a pair of hollow corner posts connected to the inner panel and interposed between the inner panel and the inner flaps.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
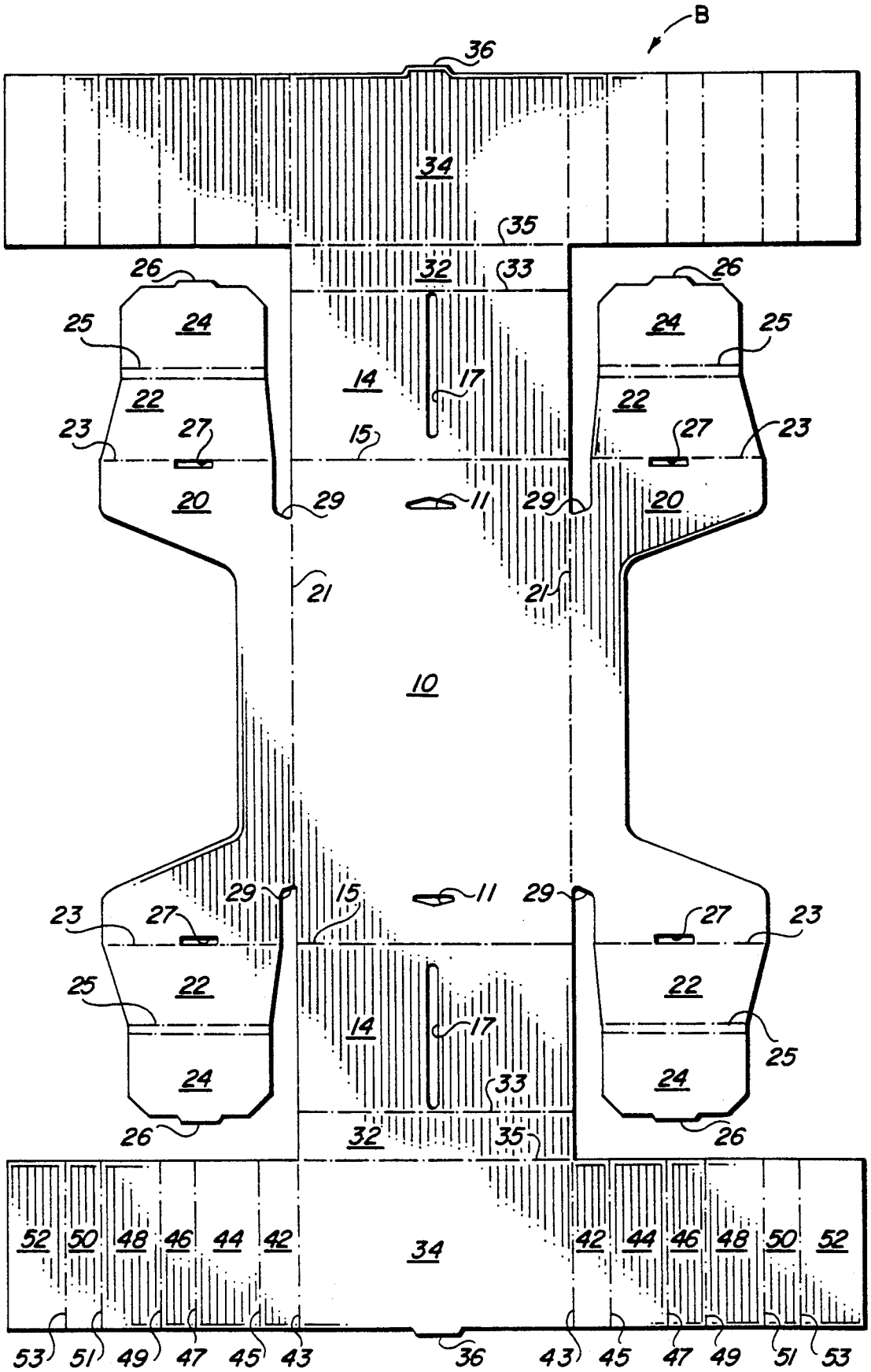
FIG. 1 is a plan view of a blank of foldable sheet material from which the tray illustrated in FIGS. 2–8 may be formed.

Referring now to the drawings for a better understanding of the invention, it will be seen that the novel display tray embodying features of the present invention, and indicated generally at T in FIGS. 2–8, may be formed from the unitary blank of foldable paperboard indicated generally at B in FIG. 1.

Figure 6:
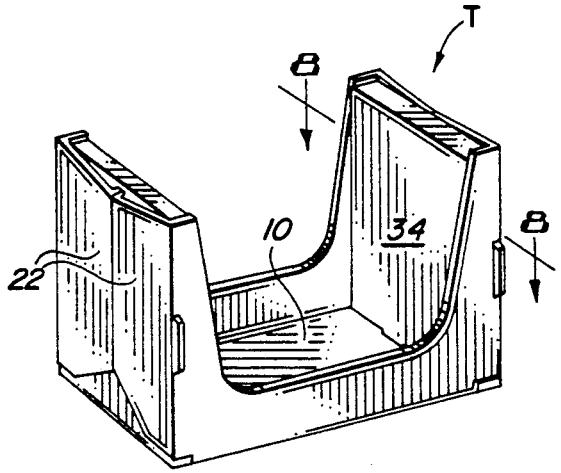
FIG. 6 is an isometric view of an erected tray embodying features of the present invention.

As best seen in FIGS. 1 and 6, Tray T includes a generally rectangular bottom wall panel having pairs of opposed side and end walls upstanding from opposed side and end edges thereof.

Bottom wall panel 10 includes a pair of lock tab receiving recesses 11 located inboardly adjacent opposite ends thereof midway between the side edges of the bottom wall panel.

The side walls are single ply, each comprising one generally U-shaped side wall panel 20 foldably joined, along a fold line 21, to an adjacent side edge of the bottom wall panel 10.

Each side wall panel has a pair of lock tab receiving recesses 27, located at opposite ends thereof, and a pair of stacking recesses 29, located at the lower corners thereof.

End walls 30 are multi-ply, each comprising a pair of outer connecting flaps 22, an outer panel 14, a pair of inner connecting flaps 24, an inner panel 34, and a pair of corner posts 40. Inner flaps 24 each have, projecting outboardly from a free end thereof, a lock tab 26 adapted to be received within a related side wall panel recess 27.

The end wall outer connecting flaps 22 are foldably joined, along fold lines 23, to the opposite end edges of each side wall panel 20; and the end wall inner connecting flaps 24 are foldably joined, along fold lines 25, to the inboard ends of the respective end wall outer connecting flaps 22.

End wall outer panels 14 are foldably joined, along fold lines 15, to the opposite ends of bottom wall panel 10; and each has foldably joined to its upper edge, along fold line 33, a relatively narrow top panel 32. Each end wall outer panel also has therein a centrally located, vertical, connecting flap receiving slot 17.

Each end wall 30 also includes an inner panel 34, having an upper edge foldably joined, along a fold line 35, to an inboard edge of top panel 32, and having, projecting downwardly from its lower edge, a lock tab 36 adapted to be received within a related bottom wall panel center recess 11 when the tray is erected.

An essential feature of the present invention is the corner post construction which enables the tray to be stacked vertically with a plurality of similar trays. The unique end wall arrangement, which includes the corner posts, not only facilitates stacking, by providing interlocking engagement between stacked trays, but it provides additional strength for load bearing, so that several trays can be stacked in a pile without damage occuring to the trays, or to the merchandise contained therein.

Figure 4:
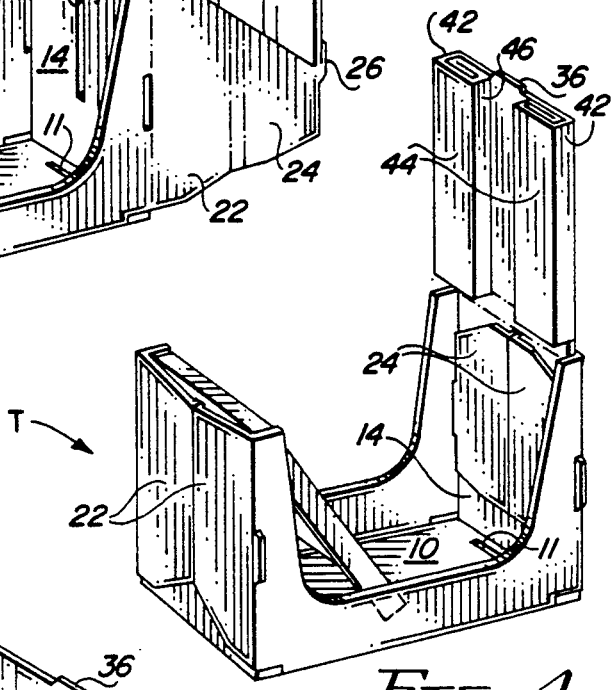
Figure 3:
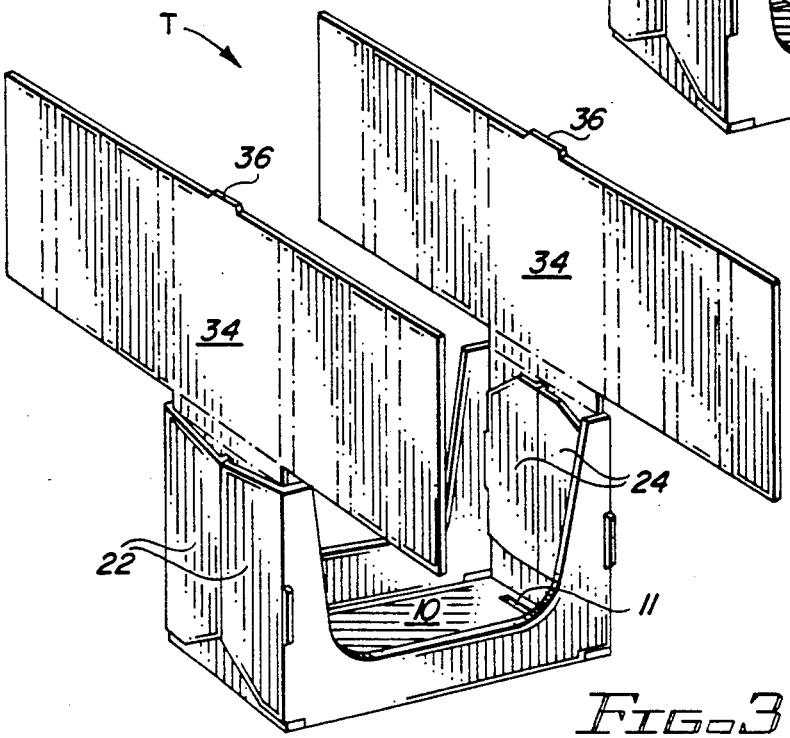
Figure 8:
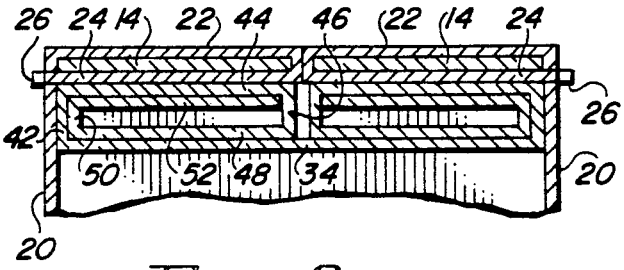
FIG. 8 is a fragmentary, horizontal, sectional view taken on line 8—8 of FIG. 6.

As best seen in FIGS. 4 and 8, the corner posts 40 are located at the corners of the tray between the end wall inner panels 34 and the adjacent end wall inner connecting flaps 24.

Each corner post 40 includes: a relatively narrow first connecting panel 42, foldably joined along a fold line 43 to an adjacent side edge of a related end wall inner panel 34; a first main panel 44, foldably joined along a fold line 45 to an adjacent side edge of first connecting panel 42; a second connecting panel 46, foldably joined along a fold line 47 to an adjacent side edge of first main panel 44; a second main panel 48, foldably joined along a fold line 49 to an adjacent side edge of second connecting panel 46; a third connecting panel 50, foldably joined along a fold line 51 to an adjacent side edge of second main panel 48; and a third main panel 52, foldably joined along a fold line 53 to an adjacent side edge of third connecting panel 50.

Figure 2:
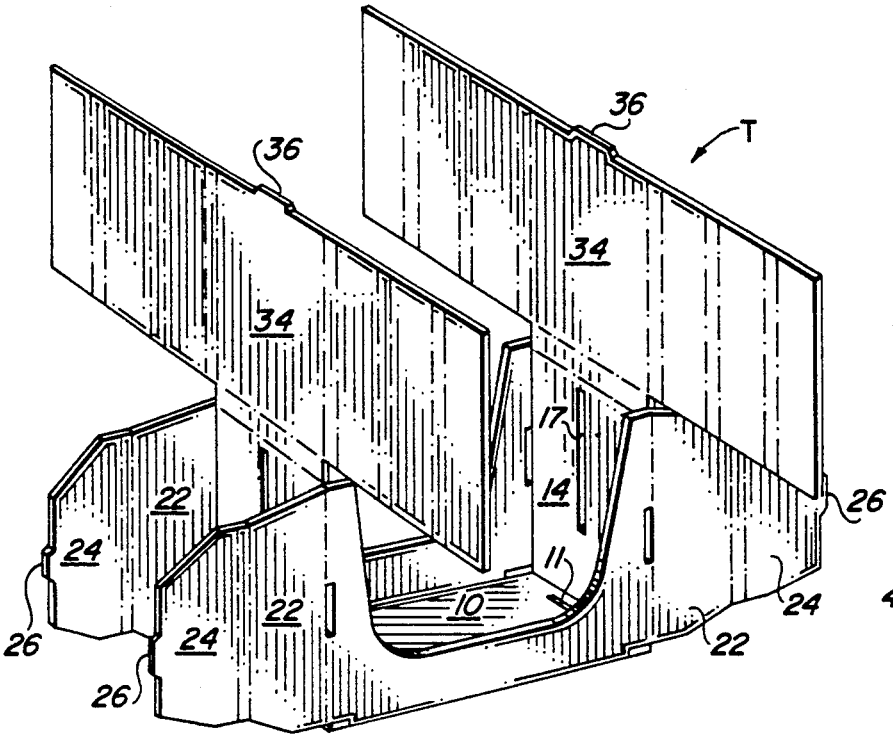
FIGS. 2–5 are fragmentary isometric views illustrating the steps involved in erecting the tray illustrated in FIG. 6.

To erect the tray T from the blank B, side wall panels 20 and end wall outer panels 14 are first folded upwardly 90 degrees from the bottom wall panel 10 to the position illustrated in FIG. 2.

The end wall outer flaps 22 are then folded inwardly 90 degrees to lie against the outer surfaces of end wall outer panels 14. The end wall inner flaps 24 are then tucked through end wall outer panel slots 17, and folded back 180 degrees, with the inner connecting flaps lying against the inner surfaces of outer panels 14 and their lock tabs 26 received within the side wall panel recesses 27, as best seen in FIGS. 4 and 8.

The corner posts 40 are then formed by folding the connecting and main panels to form hollow tubular structures, as shown in FIG. 8, with each corner post second main panel 48 lying against the adjacent surface of the related end wall inner panel 34.

Figure 5:
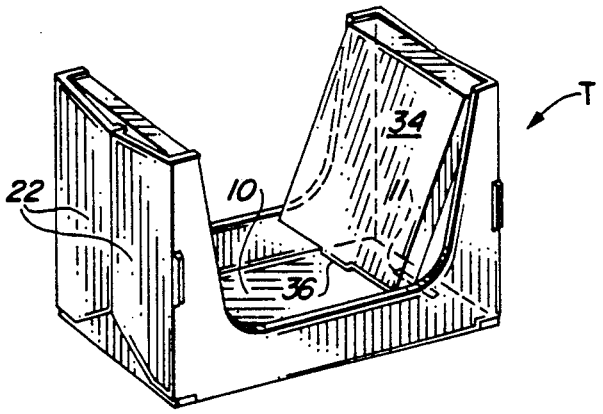

The end wall inner panels 34, with the corner posts 40 lying adjacent the panels 34, are then folded downwardly to the position shown in FIGS. 5 and 6, with the end wall inner panel lock tabs 26 positioned within the respective bottom wall panel recesses 11.

Figure 7:
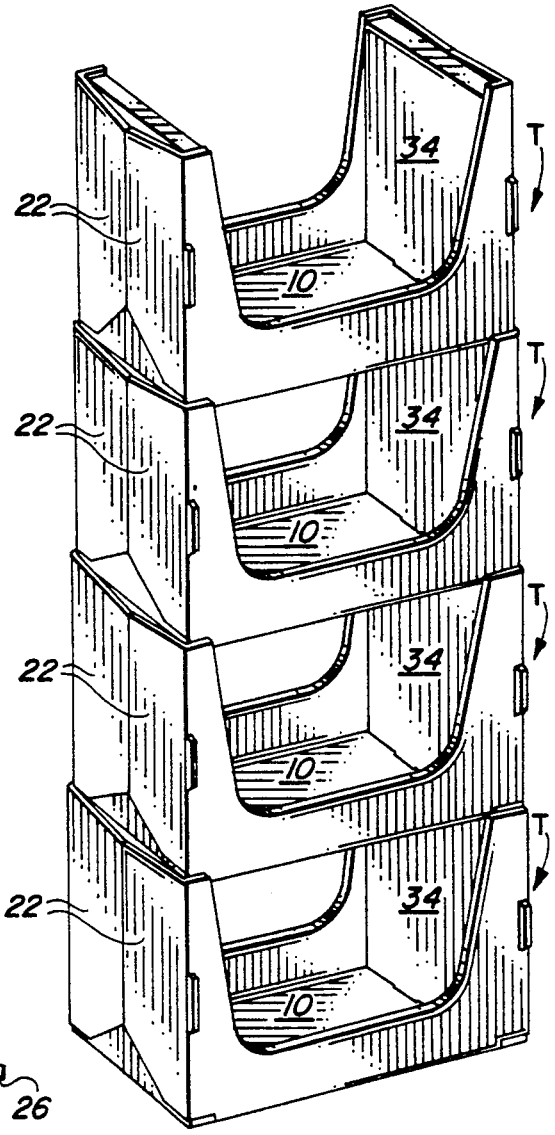
FIG. 7 is a fragmentary isometric view illustrating the manner in which trays of the type illustrated in FIG. 6 may be stacked, one atop the other.

As best seen in FIG. 7, when the tray is stacked vertically with similar trays, corner portions of the upper extremities of the tray side wall panels 20 and end wall outer connecting flaps 22 are received within the corner recesses of the side wall panels of the tray above, and the same interlocking relationship exists with the respect to the tray below.

A slightly different form of the invention is illustrated in FIGS. 9–13. The only difference between the structures of the first and second embodiments is that they are of different proportions. In FIGS. 9-13 elements corresponding those of the first embodiment have been identified by related numerals.

Figure 9:
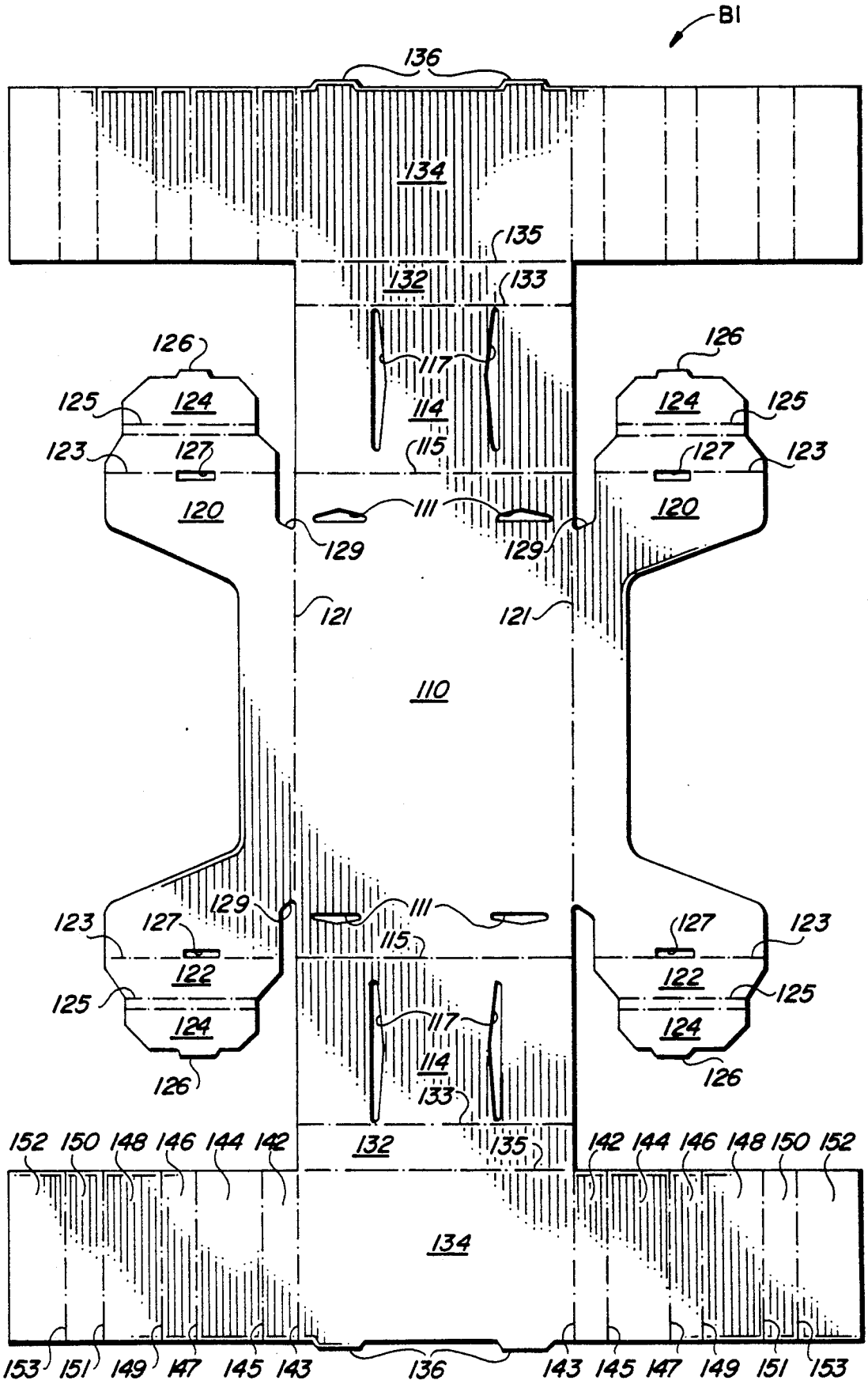
FIGS. 9, 10, 11, 12, and 13 are views corresponding to those of FIGS. 1, 5, 6, 7, and 8, respectively, but illustrate a slighty modified form of the invention.
Figure 10:
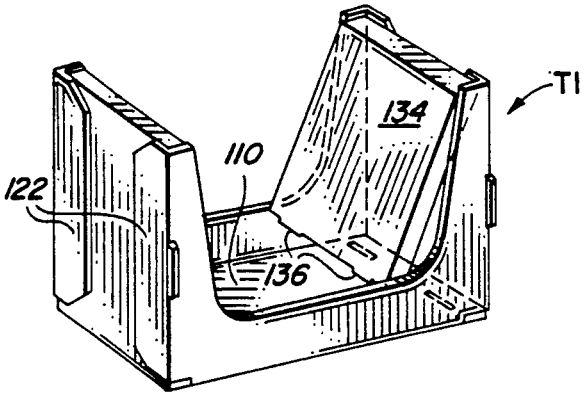
Figure 11:
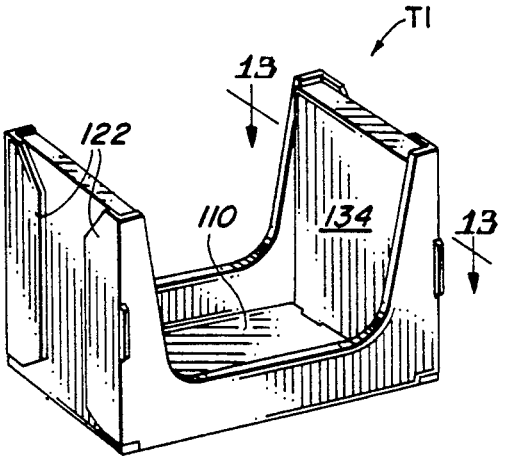
Figure 13:
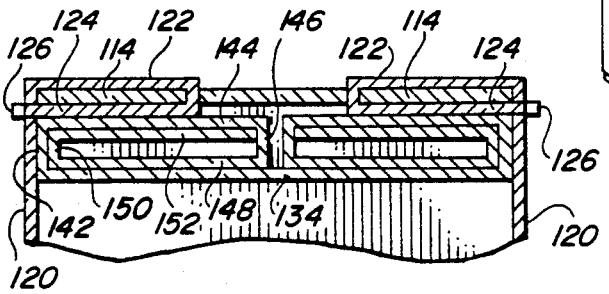
Figure 12:
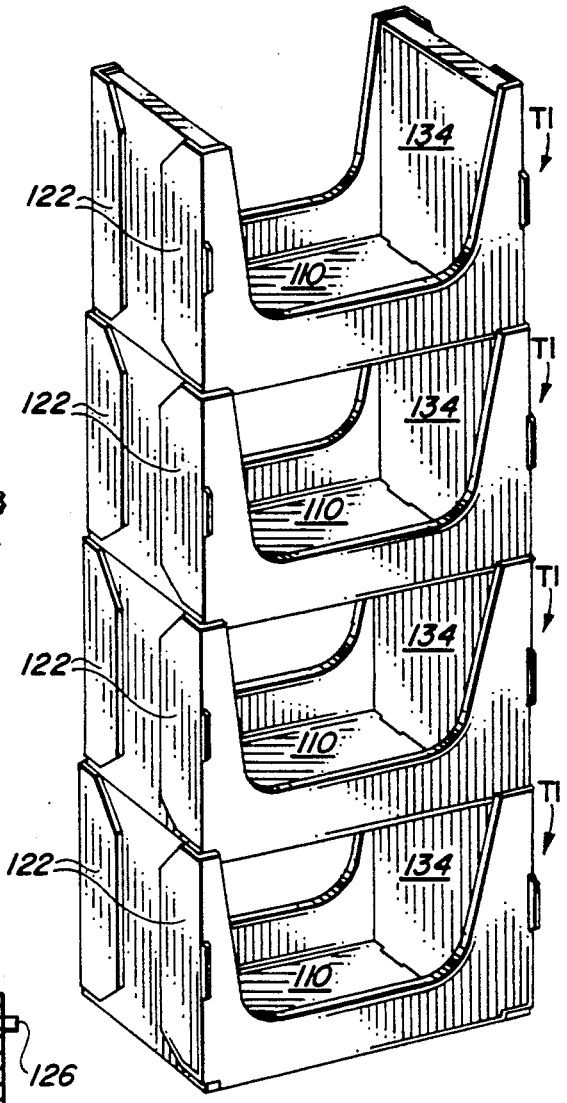

Tray T1, illustrated in FIG. 11, may be formed from the blank B1 of foldable paperboard illustrated in FIG. 9.

Since tray T1 is narrower that tray T, the end wall outer and inner connecting flaps 122 and 124 are shorter than flaps 22 and 24 and are adapted to be tucked through a pair of slots 117 in the end wall outer panel 114.

Except for dimensions, the only other difference between the embodiments is that the end wall inner panels 134 of the embodiment of FIGS. 9–13 each have a pair of separate lock tabs 136 adapted to be received within complementary recesses 111 of bottom wall panel 110.

The tray of the second embodiment is erected and can be stacked vertically in the same manner as the tray of the first embodiment. In each case a stackable tray with reinforced end walls including integral corner posts is formed from a unitary blank of foldable paperboard and can be easily and quickly erected by hand.

What is claimed is:

1. A collapsible, one-piece, display tray adapted to be stacked with other similar trays, said tray being formed from a unitary blank of foldable sheet material, such as paperboard, and comprising:

(a) a generally rectangular bottom wall panel having pairs of opposed side walls and end walls joined thereto;

(b) each of said side walls comprising a single, generally U-shaped side wall panel foldably joined to an adjacent side edge of said bottom wall panel and upstanding therefrom;

(c) each of said end walls comprising:

(i) an outer panel foldably joined to an adjacent end edge of said bottom wall panel and extending upwardly therefrom;

(ii) a relatively narrow top panel foldably joined to an upper edge of said outer panel and extending inboardly therefrom;

(iii) an inner panel foldably joined to an inboard edge of said top panel and extending downwardly therefrom in interlocking engagement with said bottom wall panel;

(iv) a pair of connecting flaps, each having outer sections joined at outer side edges to adjacent end edges of respective side wall panels and folded inwardly to lie against an outer surface of said outer panel, and having inner sections foldably joined at inner side edges to inner side edges of respective outer flaps and folded to extend through an opening in said outer panel and lie against an inner surface of said outer panel in interlocking engagement with respective side wall panels;

(d) corner posts, upstanding from each corner of said bottom wall panel between related of said inner panels and said connecting flap inner sections, each corner post comprising:

(i) a first connecting panel foldably joined to an adjacent side edge of said related end wall inner panel;

(ii) a first main panel foldably joined to an adjacent edge of said first connecting panel;

(iii) a second connecting panel foldably joined to an adjacent side edge of said first main panell (iv) a second main panel foldably joined to an adjacent edge of said second connecting panell (v) a third connecting panel foldably joined to an adjacent side edge of said second main panel;

(vi) a third main panel foldably joined to an adjacent edge of said third connecting panel.

2. A display tray according to claim 1, wherein said connecting flaps of each of said end walls extend through the same opening in said end wall outer panel.

3. A display tray according to claim 1, wherein said connecting flaps of each of said end walls extend through separate, laterally spaced openings in said end wall outer panel.

4. A display tray according to claim 1, wherein each of said end wall inner connecting flaps has, projecting outboardly therefrom, a lock tab adapted to be received within a complementary recess in a related one of said side walls.

5. A display tray according to claim 1, wherein said side wall panels have, at lower corners thereof, recesses adapted to receive upper portions of similar display trays, when stacked with them one atop the other.

6. A display tray according to claim 1, wherein said bottom wall panel has, adjacent each end thereof, at least one opening adapted, when said tray is erected, to receive a lock tab projecting from a related one of said end wall inner panels.

7. A collapsible, one-piece, display tray adapted to be stacked with other similar trays, said tray being formed from a unitary blank of foldable sheet material, such as paperboard, and comprising:

(a) a generally rectangular bottom wall panel having pairs of opposed side walls and end walls joined thereto;

(b) each of said side walls comprising a single side wall panel foldably joined to an adjacent side edge of said bottom wall panel and upstanding therefrom;

(c) each of said end walls comprising:

(i) an outer panel foldably joined to an adjacent end edge of said bottom wall panel and extending upwardly therefrom;

(ii) an inner panel foldably joined to said outer panel and extending downwardly in interlocking engagement with said bottom wall panel;

(iii) a pair of connecting flaps, each having outer sections joined at outer side edges to adjacent end edges of respective side wall panels and folded inwardly to lie against an outer surface of said outer panel, and having inner sections foldably joined at inner side edges to inner side edges of respective outer flaps and folded to extend through an opening in said outer panel and lie against an inner surface of said outer panel in interlocking engagement with respective side wall panels;

(d) corner posts, upstanding from each corner of said bottom wall panel between said inner panel and related connecting flap inner sections, each corner post comprising:

(i) a plurality of rectilinear corner post panels foldably joined to each other on parallel fold lines and folded to form a hollow tubular structure;

(ii) one of said corner post panels being foldably joined to an adjacent side edge of said end wall inner panel.

8. A display tray according to claim 7, wherein said connecting flaps of each of said end walls extend through the same opening in said end wall outer panel.

9. A display tray according to claim 7, wherein said end wall connecting flaps of each of said end walls extend through separate, laterally spaced openings in said end wall outer panel.

10. A display tray according to claim 7, wherein each of said end wall inner connecting flaps has, projecting outboardly therefrom, a lock tab adapted to be received within a complementary recess in a related one of said side walls.

11. A display tray according to claim 7, wherein said side wall panels have, at lower corners thereof, recesses adapted to receive upper portions of similar display trays, when stacked with them one atop the other.

12. A display tray according to claim 7, wherein each of said side wall panels is U-shaped with a large central opening.

13. A display tray according to claim 7, wherein said bottom wall panel has, adjacent each end thereof, at least one opening adapted, when said tray is erected, to receive a lock tab projecting from a related one of said end wall inner panels.

14. A unitary blank of foldable sheet material, such as paperboard, for use in forming a collapsible, one-piece, display tray adapted to be stacked with other similar trays, said blank being cut and scored to provide:

(a) a generally rectangular bottom wall panel having pairs of opposed side and end edges;

(b) a pair of side wall panels foldably joined to respective side edges of said bottom wall panel;

(c) a pair of end wall outer connecting flaps foldably joined to respective end edges of each of said side wall panels;

(d) end wall inner connecting flaps foldably joined to respective outboard edges of said outer connecting flaps;

(e) a pair of end wall outer panels foldably joined to respective end edges of said bottom wall panel;

(f) an end wall top panel foldably joined to an outboard edge of each of said end wall outer panels;

(g) an end wall inner panel foldably joined to an outboard edge of each of said end wall top panels;

(h) a pair of first corner post panels foldably joined to respective side edges of each of said end wall inner panels;

(i) a second corner post panel foldably joined to an adjacent side edge of each of said first corner post panels;

(j) a third corner post panel foldably joined to an adjacent side edge of each of said second corner post panels;

(k) a fourth corner post panel foldably joined to an adjacent edge of each of said third corner post panels;

(l) a fifth corner post panel foldably joined to an adjacent side edge of each of said fourth corner post panels;

(m) a sixth corner post panel foldably joined to an adjacent edge of each of said fifth corner post panels.

15. A blank according to claim 14, wherein each of said end wall outer panels as a centrally located, connecting flap receiving opening extending therethrough.

16. A blank according to claim 14, wherein each of said end wall outer panels has a pair of laterally spaced, connecting flap receiving openings extending therethrough.

17. A blank according to claim 14, wherein each of said side wall panels has, adjacent each end thereof, an inner connecting flap lock tab receiving recess, and each of said inner connecting flaps has, projecting from a free end thereof, a lock tab.

18. A blank according to claim 14, wherein said bottom wall panel and said side wall panels have corner recesses adapted to receive upper portions of similar trays, when said trays are erected, to facilitate stacking of said trays with similar trays.

19. A blank according to claim 14, wherein each of said side wall panels is generally U-shaped with relatively narrow bottom and side sections that define a relatively large central opening.

20. A blank according to claim 14, wherein said bottom wall panel has, adjacent each end thereof, at least one opening adapted, when said tray is erected, to receive a lock tab projecting from a related one of said end wall inner panels.

* * * * *